US006236295B1

(12) United States Patent
Healy

(10) Patent No.: US 6,236,295 B1
(45) Date of Patent: May 22, 2001

(54) HAZARDOUS ENVIRONMENT PRESSURE-SENSING SWITCH

(75) Inventor: James W. Healy, Hollis, NH (US)

(73) Assignee: Healy Systems, Inc., Hudson, NH (US)

( * ) Notice: Subject to any disclaimer, the term of this patent is extended or adjusted under 35 U.S.C. 154(b) by 0 days.

(21) Appl. No.: 09/491,926

(22) Filed: Jan. 27, 2000

Related U.S. Application Data

(60) Provisional application No. 60/117,400, filed on Jan. 27, 1999.

(51) Int. Cl.[7] ..... H01H 9/00; H01H 35/40

(52) U.S. Cl. ..... 335/205; 200/83 L

(58) Field of Search ..... 335/205–207; 200/81.9 M, 82 E, 83 L

(56) References Cited

U.S. PATENT DOCUMENTS 3,629,532 * 12/1971 Pisors ..... 200/81.9 R
4,132,237 1/1979 Kennedy et al. ..... 137/75
4,600,034 * 7/1986 Ko ..... 137/554
5,091,612 * 2/1992 Van Fossen ..... 200/81.9 M

OTHER PUBLICATIONS

International Search Report, dated Apr. 6, 2000, for International Appl. No. PCT/US00/02197.

* cited by examiner

*Primary Examiner*—Ramon M. Barrera
(74) *Attorney, Agent, or Firm*—Fish & Richardson, P.C.

(57) ABSTRACT

A pressure-sensing switch assembly has an electrical region and a gasoline vapor system pressure region separated by a vapor and liquid impermeable wall, without sealing or flexible membrane devices. An electrical reed switch is adjustably mounted on a flexure arm at one side of the wall and a magnet is mounted to a pivoting carrier at an opposite side of the wall. The magnet moves in response to vapor pressure in the gasoline vapor system pressure region acting on a diaphragm. The magnetic field acts through the wall to open or close the reed switch at predetermined vacuum or pressure differential conditions.

21 Claims, 4 Drawing Sheets

HAZARDOUS ENVIRONMENT PRESSURE-SENSING SWITCH

This application claims the benefit of U.S. Provisional Patent Application No. 60/117,400, filed Jan. 27, 1999.

The invention relates to pressure-sensing switches suited for use with explosive vapors.

BACKGROUND OF THE INVENTION

Pressure-sensing switches typically have a pressure-sensing region and an electrical region, with pressure information from the pressure region being communicated to the electrical region. When a pressure-sensing switch is designed for use in a hazardous environment, e.g. for monitoring gasoline vapor vacuum pressure or detecting pressure differential in a gasoline vapor flow, it is critical that the electrical region of the switch be sealed against penetration of explosive gasoline vapor from the pressure region. Typically, the necessary sealing may be provided by diaphragm displacement indication through mechanical means, with static or dynamic seals or flexible membrane devices.

SUMMARY OF THE INVENTION

According to one aspect of the invention, An explosion-proof, pressure responsive shut-off switch comprises a body defining a first, gasoline vapor system pressure region and a second, electrical region, and a vapor and liquid impermeable wall therebetween. A magnet is mounted in the first, gasoline vapor system pressure region for movement, in response to vapor pressure, between a first position spaced from the vapor and liquid impermeable wall and a second position relatively more closely adjacent the vapor and liquid impermeable wall. A reed switch is mounted in the second, electrical region in proximity to the vapor and liquid impermeable wall, and adapted to open and close a vacuum pump switch in response to movement of the magnet in between the first position and the second position.

Preferred embodiments of the invention may include one or more of the following additional features. The magnet is mounted on a pivot arm. The pivot arm has an adjustable pivot for adjusting a ratio of magnet movement relative to a given vapor pressure. The explosion proof, pressure responsive shut-off switch further comprises a spring to urge the magnet away from the vapor and liquid impermeable wall. The explosion-proof, pressure responsive shut-off switch further comprises a flexible diaphragm separating the gasoline vapor system pressure region from an atmospheric pressure region, the flexible diaphragm movable in response to a pressure ratio defined by a pressure differential between the atmospheric pressure region and the gasoline vapor system pressure region. The magnet moves in response to a movement of the diaphragm. The explosion-proof, pressure responsive shut-off switch further comprises an adjustment element for adjusting a threshold pressure ratio at which the magnet moves from the first position to the second position. The explosion-proof, pressure responsive shut-off switch further comprises an adjustable shaft mounted to the diaphragm. The reed switch is mounted on a flexure arm. The explosion-proof, pressure responsive shut-off switch further comprises a spring to urge the flexure arm away from the vapor and liquid impermeable wall. The explosion-proof, pressure responsive shut-off switch further comprises an adjustment element to adjust a position of the flexure arm relative to the vapor and liquid impermeable wall, against the spring. The explosion-proof, pressure responsive shut-off switch has unitary electrical components replaceable without removing the body from an attached vapor line. The vapor and liquid impermeable wall is a non-magnetic material, e.g., aluminum. The explosion-proof, pressure responsive shut-off switch is mounted with the diaphragm oriented vertically, to reduce gravity effects. The explosion-proof, pressure responsive shut-off switch has vapor connections in a lower portion of the gasoline vapor system pressure region to promote drainage of liquid from the region. The liquid in the gasoline vapor system pressure region is a result of condensation or overfill of an attached tank. The vacuum pump switch activates a central vane pump in a fuel dispenser. The explosion-proof, pressure responsive shut-off switch is adjusted to maintain vapor pressure in the gasoline vapor system pressure region A at −65 inch WC. The explosion-proof, pressure responsive shut-off switch is arranged to activate the vacuum pump switch in response to a pressure differential between the gasoline vapor system pressure region and a region exterior to the gasoline vapor system pressure region, e.g., an atmospheric pressure region. The explosion-proof, pressure responsive shut-off switch is adjusted to activate the vacuum pump switch when said pressure differential is ½-inch WC.

The pressure-sensing switch assembly of the invention provides substantial improvement over commercially available switches for gasoline vapor vacuum or pressure differential applications. In particular, the invention provides a pressure-sensing switch assembly in which the gasoline vapor system pressure region of the assembly is separated from the electrical region by a solid metal wall. There are no static or dynamic seals or flexible membrane devices required to separate the two regions, as necessary when providing diaphragm displacement indication through mechanical means. The separation wall is non-magnetic metal, preferably aluminum.

Other features and advantages of the invention will be apparent from the following description of a presently preferred embodiment, and from the claims.

DESCRIPTION OF THE PREFERRED EMBODIMENTS

Figure 1:
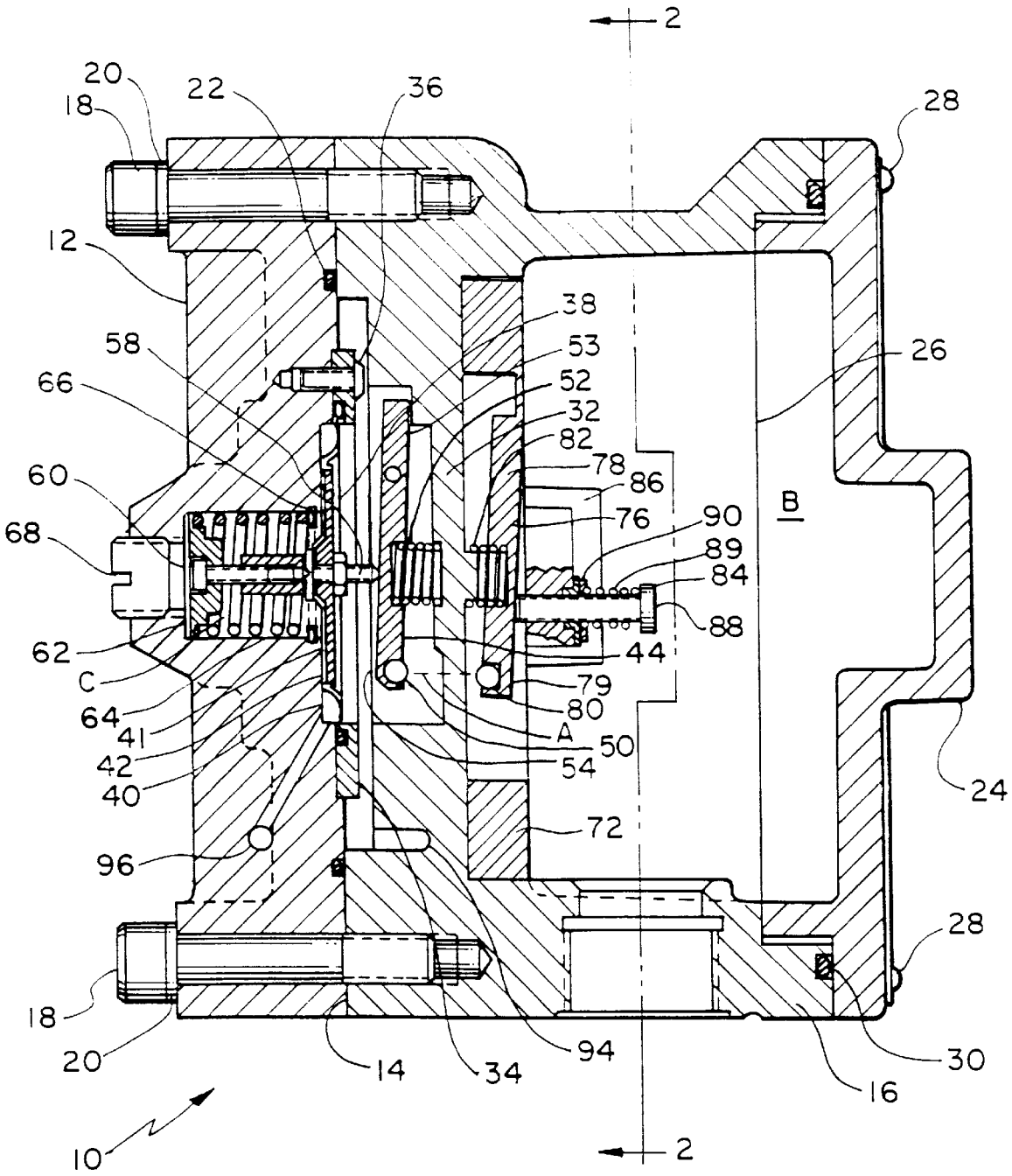
FIG. 1 is a front section view of a first embodiment of a hazardous environment pressure-sensing switch assembly of the invention, e.g., for use in monitoring gasoline vapor vacuum pressure of a central vacuum pump.
Figure 2:
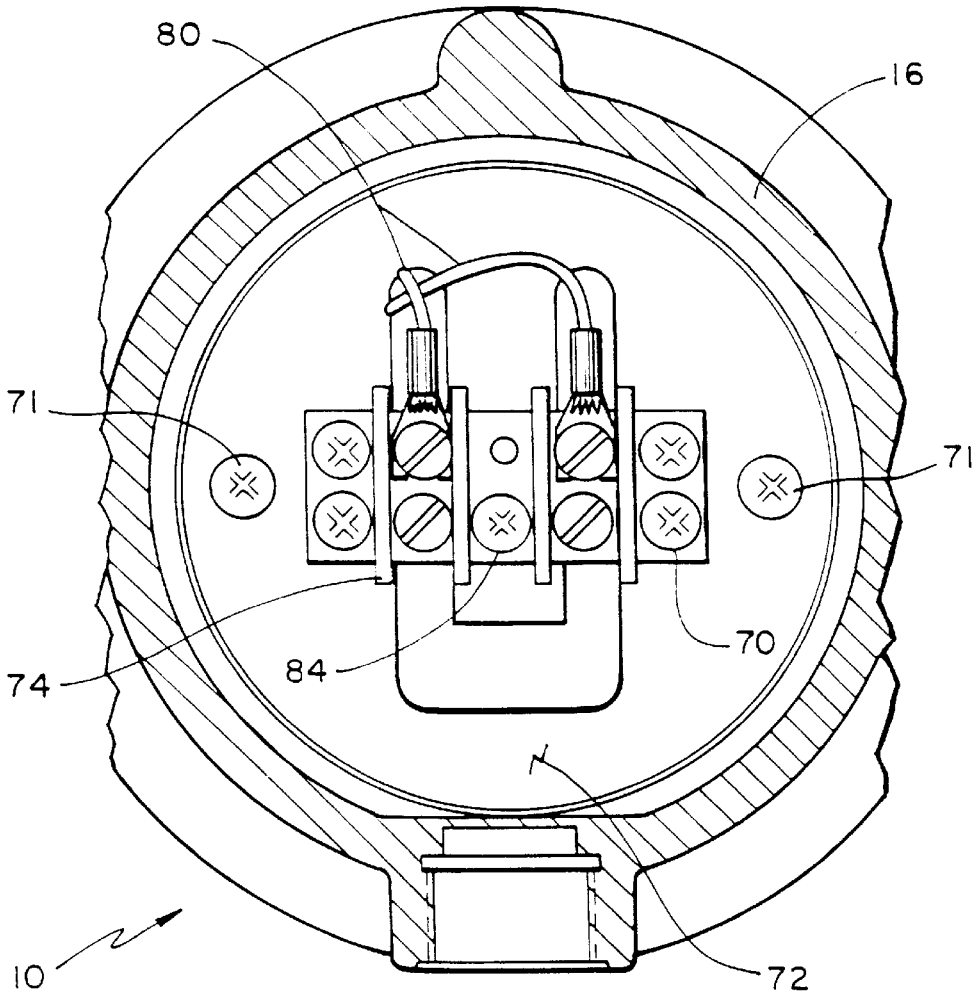
FIG. 2 is a side section view of the pressure-sensing switch assembly of FIG. 1, taken at the line 2—2 of FIG. 1.

Referring to FIGS. 1–4, a pressure-sensing switch assembly 10 of the invention, e.g. for use in hazardous locations, such as in gasoline vapor vacuum or pressure systems, has a base 12 attached at one face 14 of a body 16, e.g. by socket head screws 18 secured by lock washers 20, with sealing provided by o-ring 22. A cover 24 is attached to an opposite face 26 the body 16, e.g., by drive screws 28, with sealing provided by o-ring 30.

A gasoline vapor system pressure region (region A) is defined generally at the intersection of the base 12 and body 16. An electrical region (region B) is defined by the body 16 and cover 24. Region A is separated from region B by a solid metal wall 32, without static or dynamic seals or flexible membrane devices to separate the two regions, such as would be required to provide diaphragm displacement indication through mechanical means. Preferably, the separation wall 32 is non-magnetic, e.g. aluminum. Mounted to the base 12 at the intersection of the base and body 16 (e.g., by retaining ring 34 secured by button head cap screws 36) is a diaphragm assembly 38, including a diaphragm 40 having a first surface 41 which, in part, defines the gasoline vapor system pressure region (region A), and an opposite, second surface 42 which, with the base 12, defines a region at atmospheric pressure (region C).

Figure 3:
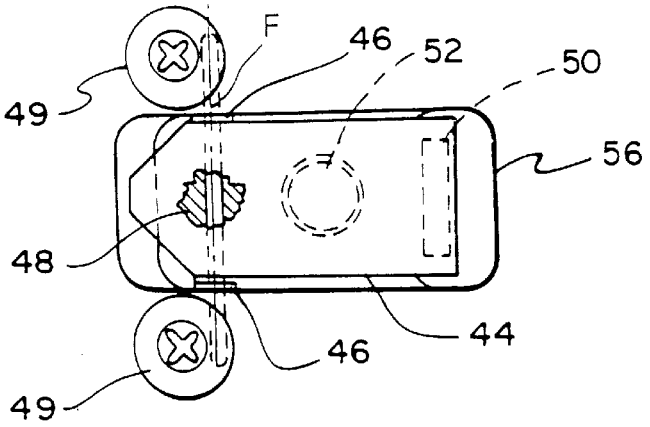
FIG. 3 is a plan view of the permanent magnet carrier in the pressure-sensing switch assembly of FIG. 1.
Figure 4:
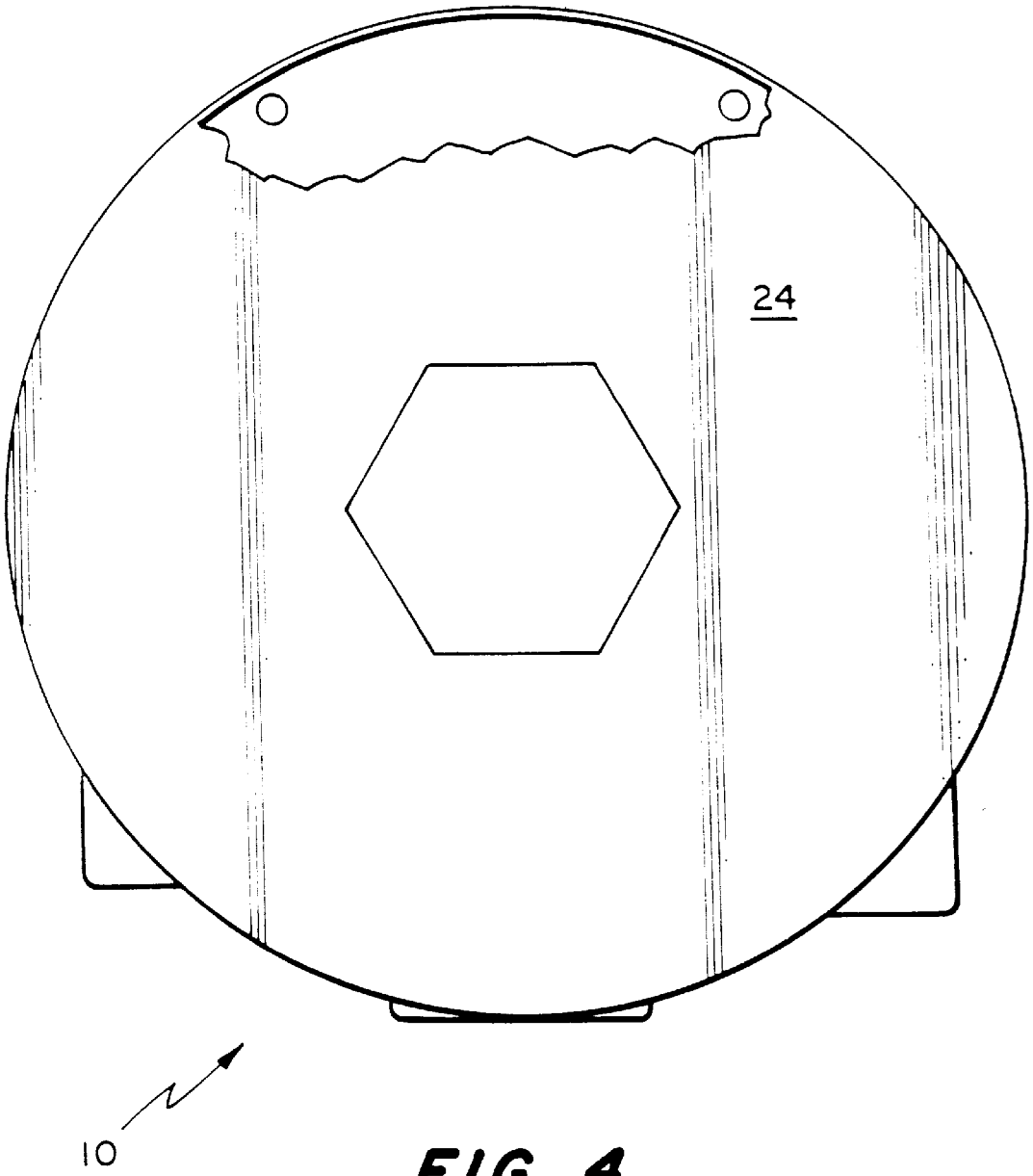
FIG. 4 is a side plan view of the pressure-sensing switch assembly of FIG. 1.

Referring to FIG. 3, disposed within the gasoline vapor system pressure region (region A) is a magnet carrier 44 supported by flat washers 46 on pivot pin 48 (positioned by Phillips 100° flat head screw and washer assemblies 49) to pivot on axis, P, of the pivot pin 48, with a bar magnet 50 mounted at one end. The magnet 50 is urged away from the wall 32 by a compression spring 52 mounted between the wall 32 and the magnet carrier 44, and bearing on a first surface 53 of the carrier 44 at a position between the pivot pin 48 and the end 56 of the carrier 44 carrying the magnet 50. Opposing the spring 52, and urging the magnet 50 toward the wall 32, is a threaded shaft 58 mounted to and extending from the diaphragm 40, the threaded shaft 58 engaging an opposite, second surface 54 of the magnet carrier 44 at a point generally opposite to the point of engagement by the spring 52 upon the carrier first surface 53.

In a first embodiment, e.g., for monitoring a central vacuum pump, the position of the diaphragm 40 is adjusted by means of a threaded element 60 (e.g., a socket head machine screw) engaged in a spring guide 62 and adjusted against the force of a compression spring 64 disposed between the spring guide 62 and a retaining ring 66 mounted to the base 12. Access to the threaded element 60 is obtained by removing pipe plug 68.

Mounted to the body within the electrical region (region B) by hold-down screws 70, 71, e.g., Phillips pan head screws, is an insulator disk 72, to which is mounted a terminal strip 74. Disposed central to the insulator disk 72 is a flexure arm 76 having a first (fixed) end 78 secured to the body 16 and a second (free) end 79. A pre-wired glass reed switch 80 is mounted at the free end 79 of the flexure arm 76. A compression spring 82, disposed between the body 16 and the flexure arm 76, at a position between the first (fixed) end 78 and the second (free) end 79, urges the free end 79 of the flexure arm 76 away from the wall 32. The free end of the flexure arm is urged toward the wall, in opposition to the force of compression spring 82, by threaded member 84 (e.g., a Phillips pan head screw) rotatably mounted to a body element 86. The position of the free end 79 of the flexure arm 78 is adjusted by rotation of screw head 88, under force of compression spring 89 between screw head 88 and washer 90.

Electrical switch actuation is caused by the magnetic field produced by the bar magnet 50 on the gasoline vapor side (region A) of the assembly. As the magnet 50 (on magnet carrier 44) moves toward the reed switch 80, the magnetic field increases to a level sufficient to close the reed switch (on the flexure arm 76). Moving the magnet 50 in the opposite direction reduces the magnetic field until the reed switch 80 snaps open.

The closure point of the reed switch 80, mounted to the flexure arm 76, is adjusted by slowly turning threaded member 84 to bend the flexure arm downward against compression spring 82 and toward the magnet 50. As the adjustment is made, the magnet 50 is held against a suitable spacer (not shown) to simulate the desired air gap between the magnet 50 and the separation wall 32. When the switch 80 closes, a trip point is established for sensing the desired vacuum differential.

For an application requiring a signal at −65 inches water column, e.g. to monitor a central vacuum pump, a vacuum of 65 inches water column is applied to the chamber above the diaphragm assembly 38 (region A). With the pipe plug 68 removed and region C at atmospheric pressure (via connection 96), the threaded element 60 is turned counterclockwise to reduce the force from spring 64 acting on guide 62 until the threaded shaft 58 extending from the center of the diaphragm 40 toward the wall 32 pushes the magnet carrier 44 towards the previously adjusted reed switch 80. The set for −65 inches water column is achieved when reed switch closure occurs.

The position of the pivot axis, P, about which the magnet carrier 44 is designed to pivot determines the relative switch sensitivity. Moving the pivot axis closer to the center of the diaphragm assembly 38 will cause increased movement of the magnet 50 in relation to movement of the diaphragm 40. For example, the switch design shown in FIG. 1 (and in FIG. 5) provides a two-to-one relationship.

The pre-wired glass reed switch 80, terminal strip 74 and switch adjustment screw 84 can be field replaced as a unit by removing the two hold-down screws 71. This is a major advantage over commercially available products which require replacement of the entire switch assembly, thus requiring opening of vacuum piping (not shown) filled with gasoline vapors returning to the underground storage tanks.

Figure 5:
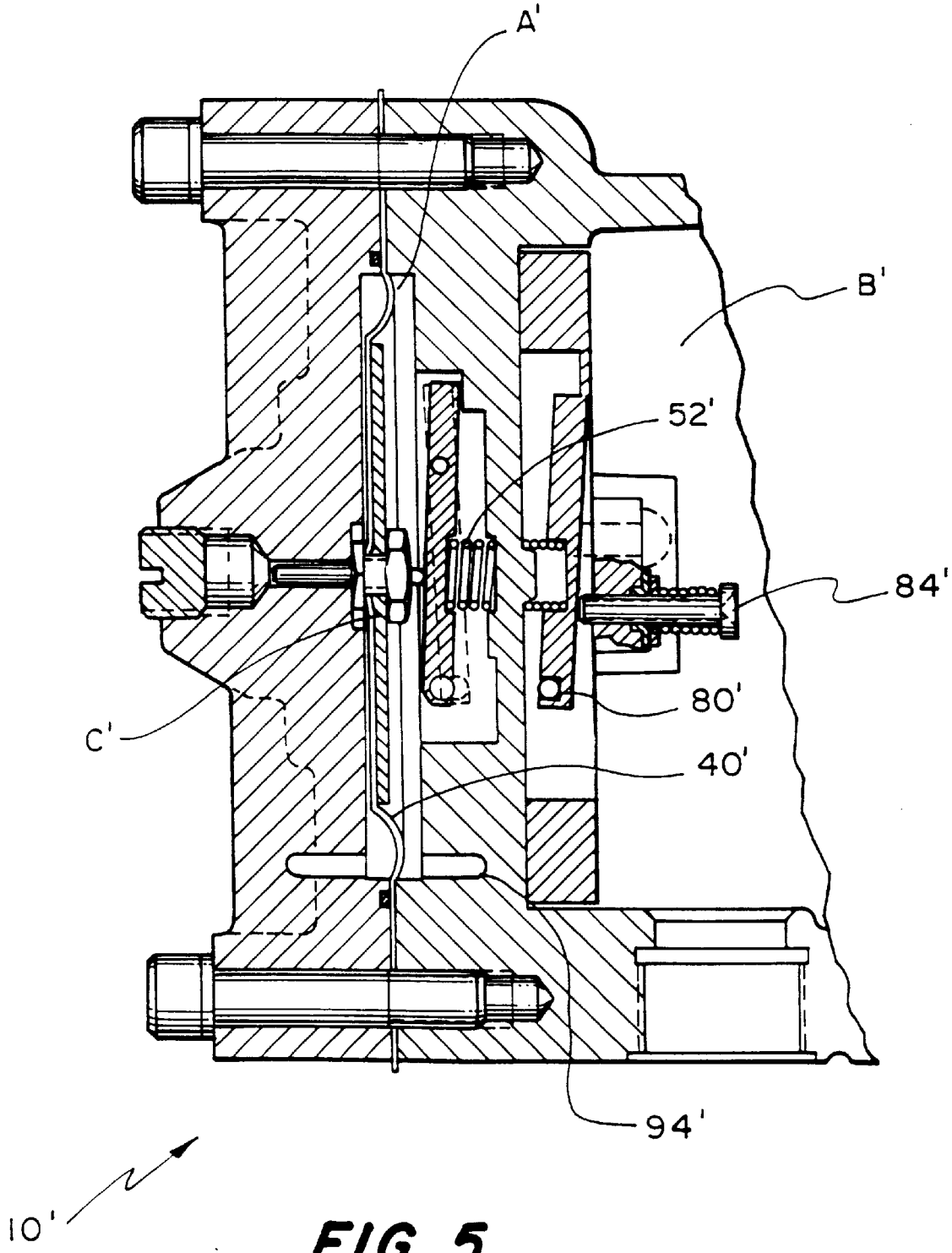
FIG. 5 is a front section view of another embodiment of a hazardous location pressure-sensing switch assembly of the invention, e.g., for use in detecting pressure differential for a gasoline vapor flow.

This feature is even more important in other embodiments, e.g., referring to FIG. 5, for pressure-sensing switches of the invention employed for vent monitoring applications. In particular, by allowing replacement of the switch assembly electrical components without opening the underground tank vapor space, escape of gasoline vapor to the atmosphere (which can occur if the tank vapor space is at a positive pressure) is restricted or prevented.

Referring now to FIG. 5, in another embodiment of a pressure-sensing switch assembly of the invention, e.g. for vent monitoring, the switch assembly 10' is designed to detect a ½ inch water column pressure differential when gasoline vapors flow through a small orifice mounted in the vent pipe (not shown). Gasoline vapor flow through the orifice will occur whenever the cracking pressure of the vent valve is exceeded. In this application, the force provided by the compression spring 52' is selected to offset the ½ inch water column differential acting on the larger diaphragm 40'. Switch point adjustment is accomplished by turning screw 84' to move reed switch 80' to the desired set point, while a ½ inch water column vacuum is applied to the space above the diaphragm 40' (region A').

In both embodiments of pressure sensing switch assemblies 10, 10' of the invention, it is preferred that the assembly be mounted with the diaphragm 40, 40' in a vertical plane (as shown in the drawings), thus to reduce the gravity effect on switch action and, further, that the vapor connections 94, 94' be horizontal and below the center of the assembly, thereby to promote liquid drainage if condensate forms or if accidental overfilling of the underground tanks causes liquid to reach the pressure-sensing switch assembly.

Other embodiments are within the scope of the following claims.

What is claimed is:

1. An explosion-proof, pressure responsive shut-off switch comprising:

a body defining a first, gasoline vapor system pressure region and a second, electrical region, and a vapor and liquid impermeable wall therebetween, a magnet mounted in the first, gasoline vapor system pressure region for movement, in response to vapor pressure, between a first position spaced from said vapor and liquid impermeable wall and a second position relatively more closely adjacent said vapor and liquid impermeable wall, said magnet being mounted on a pivot arm, said pivot arm having an adjustable pivot for adjusting a ratio of movement of said magnet, relative to said vapor and liquid impermeable wall, to change in vapor pressure, and a reed switch mounted in the second, electrical region in proximity to said vapor and liquid impermeable wall, and adapted to open and close a vacuum pump switch in response to movement of said magnet between said first position and said second position.

2. The explosion-proof, pressure responsive shut-off switch of claim 1, further comprising a spring to urge said magnet away from said vapor and liquid impermeable wall.

3. The explosion-proof, pressure responsive shut-off switch of claim 1, further comprising a flexible diaphragm separating said first, gasoline vapor system pressure region from an atmospheric pressure region, said flexible diaphragm movable in response to a pressure ratio defined by a pressure differential between said atmospheric pressure region and said gasoline vapor system pressure region.

4. The explosion-proof, pressure responsive shut-off switch of claim 3, wherein said magnet moves in response to a movement of said diaphragm.

5. The explosion-proof, pressure responsive shut-off switch of claim 3, further comprising an adjustment element for adjusting a threshold pressure ratio at which said magnet moves from said first position to said second position.

6. The explosion-proof, pressure responsive shut-off switch of claim 5, further comprising an adjustable shaft mounted to said diaphragm.

7. The explosion-proof, pressure responsive shut-off switch of claim 3, mounted with said diaphragm oriented vertically, to reduce gravity effects.

8. The explosion-proof, pressure responsive shut-off switch of claim 1, wherein said reed switch is mounted on a flexure arm.

9. The explosion-proof, pressure responsive shut-off switch of claim 8, further comprising a spring to urge said flexure arm away from said vapor and liquid impermeable wall.

10. The explosion-proof, pressure responsive shut-off switch of claim 9, further comprising an adjustment element to adjust a position of said flexure arm relative to said vapor and liquid impermeable wall, against said spring.

11. An explosion-proof, pressure responsive shut-off switch comprising:

a body defining a first, gasoline vapor system pressure region and a second, electrical region, and a vapor and liquid impermeable wall therebetween, a magnet mounted in the first, gasoline vapor system pressure region for movement, in response to vapor pressure, between a first position spaced from said vapor and liquid impermeable wall and a second position relatively more closely adjacent said vapor and liquid impermeable wall, said magnet being mounted on a pivot arm, and a reed switch mounted in the second, electrical region in proximity to said vapor and liquid impermeable wall, and adapted to open and close a vacuum pump switch in response to movement of said magnet between said first position and said second position, said reed switch being mounted on a flexure arm.

12. The explosion-proof, pressure responsive shut-off switch of claim 11, further comprising a spring to urge said flexure arm away from said vapor and liquid impermeable wall.

13. The explosion-proof, pressure responsive shut-off switch of claim 12, further comprising an adjustment element to adjust a position of said flexure arm relative to said vapor and liquid impermeable wall, against said spring.

14. The explosion-proof, pressure responsive shut-off switch of claim 1 or claim 11, having unitary electrical components replaceable without removing said body from an attached vapor line.

15. The explosion-proof, pressure responsive shut-off switch of claim 1 or claim 11, wherein said vapor and liquid impermeable wall is a non-magnetic material.

16. The explosion-proof, pressure responsive shut-off switch of claim 15, wherein said non-magnetic material is aluminum.

17. The explosion-proof, pressure responsive shut-off switch of claim 1 or claim 11, having vapor connections in a lower portion of said gasoline vapor system pressure region to promote drainage of liquid from said gasoline vapor system pressure region.

18. The explosion-proof, pressure responsive shut-off switch of claim 1 or claim 11, having vapor connections in a lower portion of said gasoline vapor system pressure region to promote drainage from said gasoline vapor system pressure region of liquid resulting from condensation or overfill of an attached tank.

19. The explosion-proof, pressure responsive shut-off switch of claim 1 or claim 11, adapted to provide a vacuum level signal to a system monitor.

20. The explosion-proof, pressure responsive shut-off switch of claim 19, adjusted to signal when vapor pressure in said gasoline vapor system pressure region is at −65 inch WC.

21. The explosion-proof, pressure responsive shut-off switch of claim 1 or claim 11, adjusted to activate a vacuum pump switch when said pressure differential is ½-inch WC.

* * * * *